US012264468B2

(12) United States Patent
Chong et al.

(10) Patent No.: US 12,264,468 B2
(45) Date of Patent: Apr. 1, 2025

(54) WORK STATION LOCKING ASSEMBLY

(71) Applicant: EMC Water LLC, Downers Grove, IL (US)

(72) Inventors: Jonathan Chee Yeen Chong, Palatine, IL (US); Michael Grady, Chicago, IL (US); Michael Seskauskas, Chicago, IL (US)

(73) Assignee: EMC Water LLC, Downers Grove, IL (US)

( * ) Notice: Subject to any disclaimer, the term of this patent is extended or adjusted under 35 U.S.C. 154(b) by 0 days.

(21) Appl. No.: 18/079,676

(22) Filed: Dec. 12, 2022

(65) Prior Publication Data

US 2023/0183958 A1 Jun. 15, 2023

Related U.S. Application Data

(60) Provisional application No. 63/288,934, filed on Dec. 13, 2021.

(51) Int. Cl.
*E03C 1/18* (2006.01)

(52) U.S. Cl.
CPC ..... *E03C 1/18* (2013.01)

(58) Field of Classification Search
CPC ..... E03C 1/18
See application file for complete search history.

(56) References Cited

U.S. PATENT DOCUMENTS

| | | | | |
|---|---|---|---|---|
| 9,783,967 | B2 * | 10/2017 | Jain | E03C 1/18 |
| 11,781,302 | B2 * | 10/2023 | Grybush | A47B 77/06 4/619 |
| 2008/0148475 | A1 † | 6/2008 | Lin | |
| 2014/0027966 | A1 * | 1/2014 | Constantino, Jr. | A47J 47/16 269/15 |
| 2015/0067962 | A1 * | 3/2015 | O'Brien | A47J 47/005 4/630 |
| 2018/0030704 | A1 * | 2/2018 | Bomatter | E03C 1/186 |
| 2021/0196083 | A1 † | 7/2021 | Raleigh | |
| 2021/0254318 | A1 † | 8/2021 | Davis | |
| 2021/0332578 | A1 † | 10/2021 | Miller | |

FOREIGN PATENT DOCUMENTS

| | | | |
|---|---|---|---|
| CN | 213572210 | † | 6/2021 |
| EP | 2071979 | † | 6/2009 |
| JP | 2014161563 | † | 9/2014 |
| NZ | 554577 | † | 6/2008 |
| WO | WO2005073475 | † | 1/2005 |

* cited by examiner
† cited by third party

*Primary Examiner* — Christine J Skubinna
(74) *Attorney, Agent, or Firm* — Husch Blackwell LLP

(57) ABSTRACT

An example sink is provided. The example sink includes a basin having a rear wall, a front wall, a first side wall, a second side wall, and a bottom, having a top flange connected to the basin. The basin of the sink defines a top ridge below the top flange, the top ridge extending inward from the rear wall, and extending along the rear wall from the first side wall to the second side wall. The basin of the sink also defines one or more bottom ridges extending inward from the rear wall, the front wall, and one of the first side wall and the second side wall.

19 Claims, 16 Drawing Sheets

100

100

200

WORK STATION LOCKING ASSEMBLY

CROSS-REFERENCE TO RELATED APPLICATION

This application claims the benefit of U.S. Provisional Application Ser. No. 63/288,934, filed on Dec. 13, 2021, which is incorporated by reference in its entirety.

TECHNICAL FIELD

The present disclosure relates generally to sinks and sink accessories, and in particular to sinks and sink accessories that can be inserted in and locked in place in the sink.

BACKGROUND

Sinks are often used in kitchens along with countertops, cutting boards, colanders, and other accessories for use in the preparation of food. Sinks may also be used in laundry rooms, business, or in other contexts where the sink can have a dual function, acting as both a typical sink and as a work surface. Sinks used in this dual fashion may sometimes be referred to as a 'work center' or 'work station.'

SUMMARY

The present disclosure summarizes aspects of some contemplated embodiments, and should not be used to limit the scope of the claims. Other implementations are contemplated in accordance with the techniques described herein, as will be apparent to one having ordinary skill in the art upon examination of the following drawings and detailed description, and these implementations are intended to be within the scope of this application.

In one example, a sink includes a basin including a rear wall, a front wall, a first side wall, a second side wall, and a bottom. The sink also includes a top flange connected to the basin, wherein the basin defines a top ridge below the top flange, the top ridge extending inward from the rear wall, and extending along the rear wall from the first side wall to the second side wall, and wherein the basin defines one or more bottom ridges extending inward from the rear wall, the front wall, and one of the first side wall and the second side wall.

In a second example, a sink includes a basin including a rear wall, a front wall, a first side wall, a second side wall, and a bottom. The sink also includes a top flange connected to the basin, wherein the basin defines a top ridge below the top flange. The top ridge comprises an upper portion extending inward from the rear wall, and extending along the rear wall from the first side wall, and a lower portion extending inward from the rear wall, and extending along the rear wall from the second side wall, wherein the upper portion and the lower portion are connected by an angled portion.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
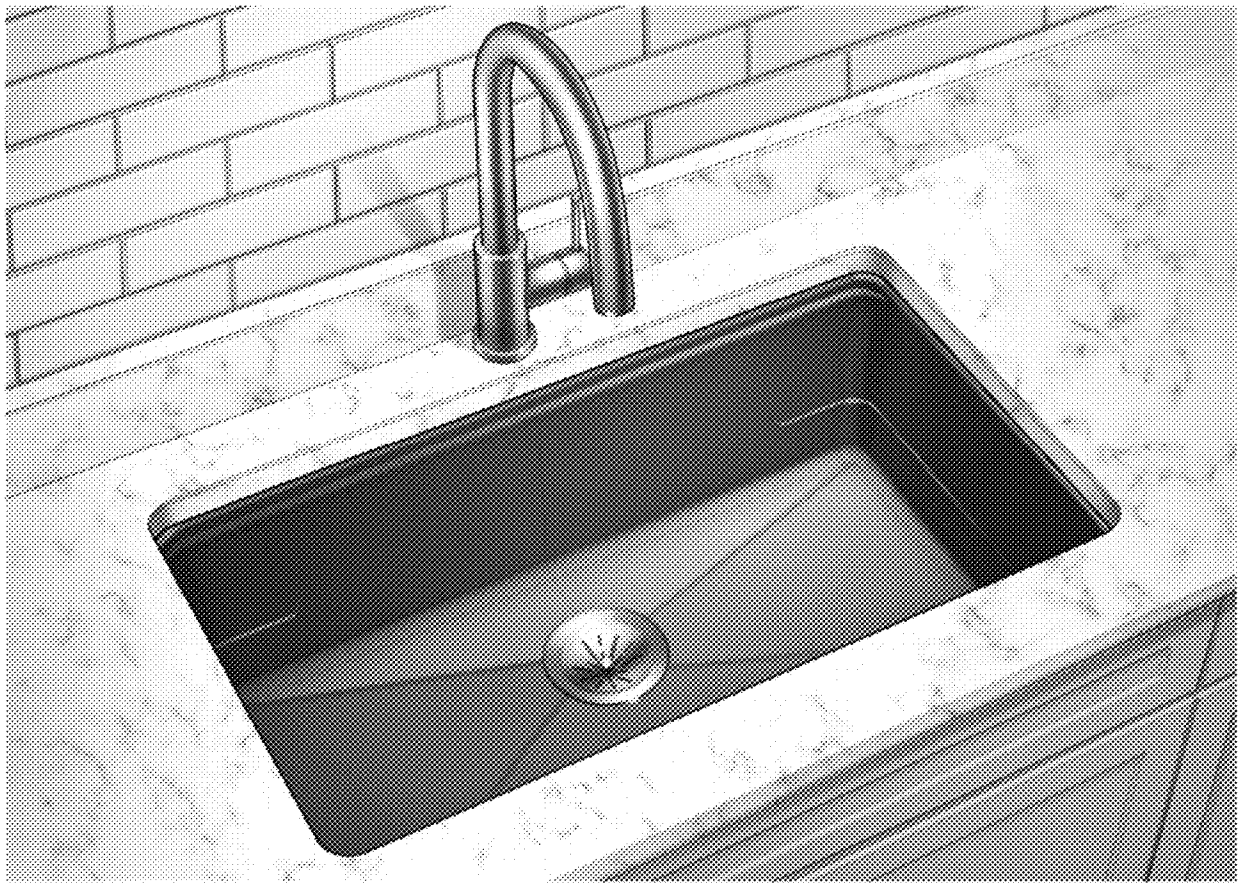
FIG. 1 illustrates a front perspective view of an example sink according to a first embodiment.
Figure 2:
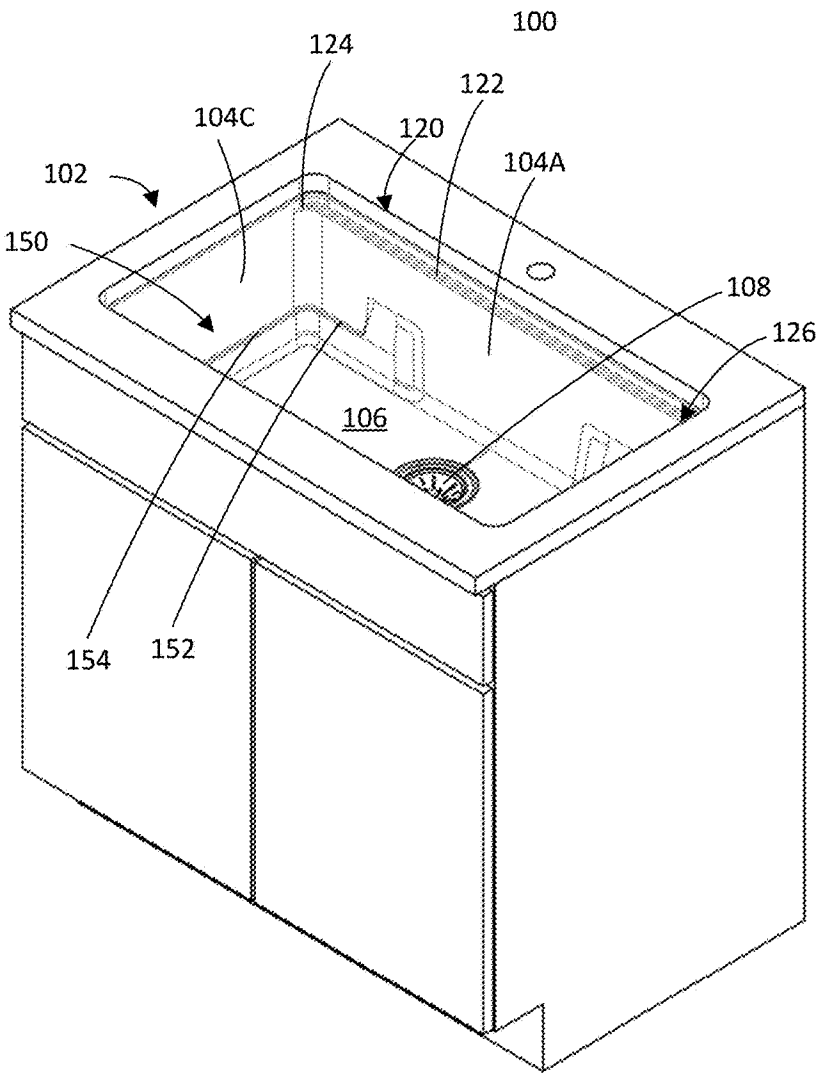
FIG. 2 illustrates another front perspective view of the sink of FIG. 1.
Figure 3:
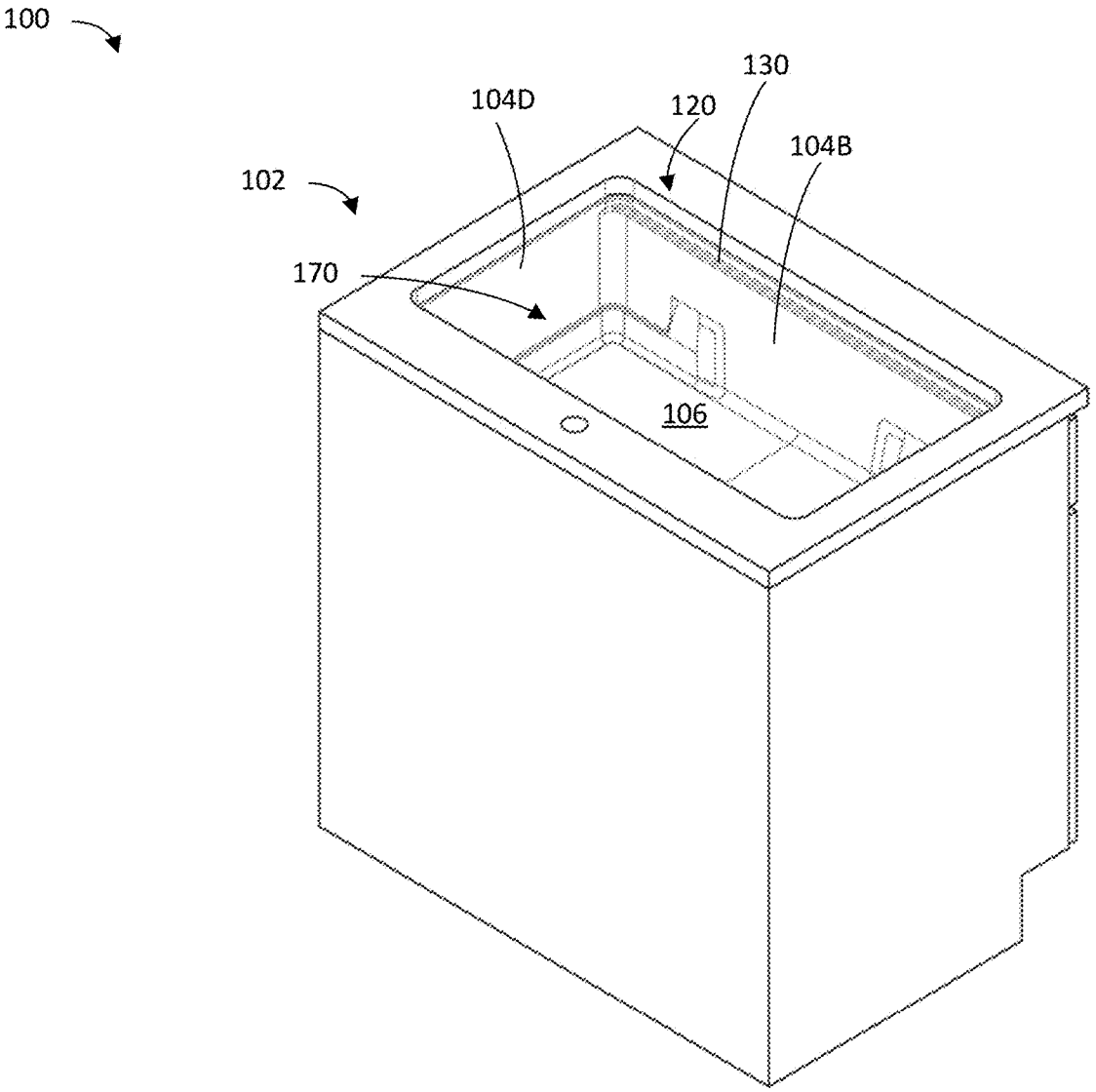
FIG. 3 illustrates a rear perspective view of the sink of FIG. 1.
Figure 4:
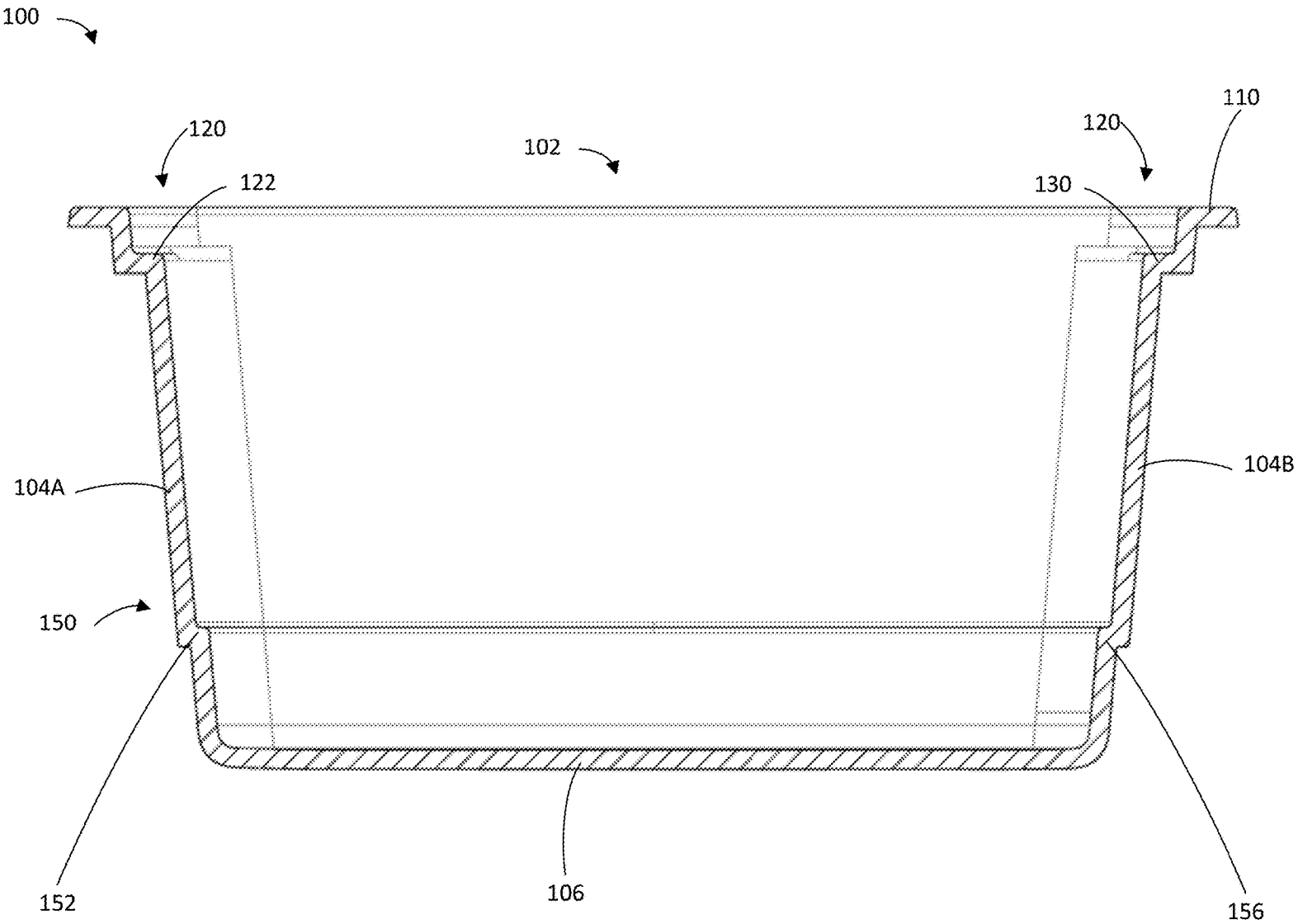
FIG. 4 illustrates a cross section view of the sink of FIG. 1, showing the top ridge and bottom ridge.
Figure 5:
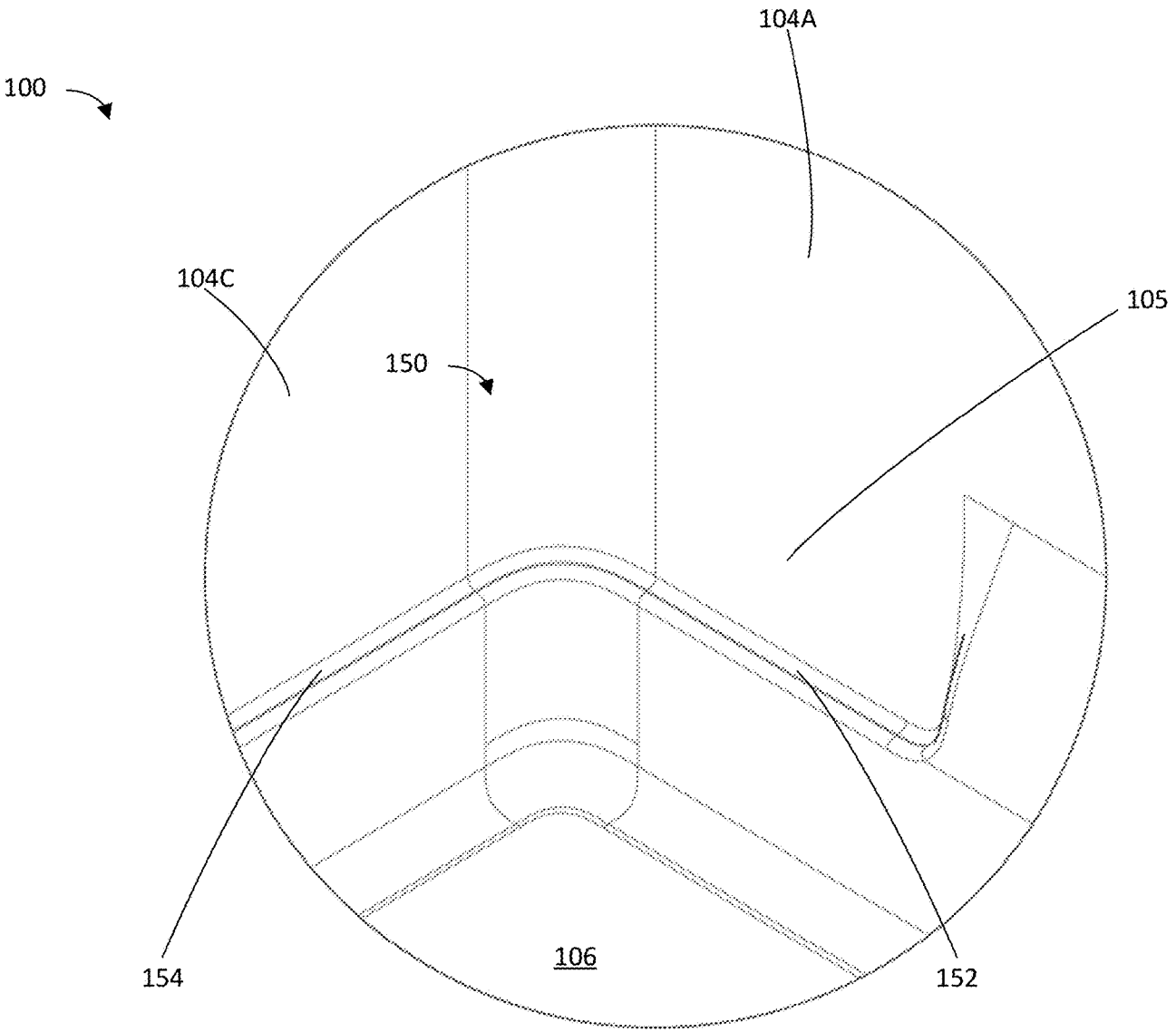
FIG. 5 illustrates a zoomed in view of an interior bottom corner of the sink of FIG. 1, showing the bottom ridge.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Example sinks and accessories disclosed herein are configured to create secure work surfaces, centers, and/or stations over the tops of and/or within the sinks that improve the utility, organization, and safety associated with work stations. The sinks and accessories are configured to create work stations at different levels relative to the sink. The sinks and accessories also include features and machining tolerances that enable the accessories to be securely positioned in place. In turn, the accessories (e.g., cutting boards, drying racks, colanders, etc.) are able to be fixed in place to avoid unintentional movement of the respective work stations. Such unexpected movements have previously occurred with work stations when a user is cutting on a cutting board, when a water stream is directed onto the accessory, etc. Examples disclosed herein also are configured to provide haptic feedback that an accessory is "locked in place" to remove uncertainty associated with positioning the accessory over a sink. Additionally, examples disclosed herein are configured to isolate work surfaces of a work station (e.g., a cutting board or a colander) from potentially unsanitary surfaces of the sink.

A sink 100 is shown in FIGS. 1-6. The sink 100 may be a molded, quartz sink, or may be made from various other materials. The sink 100 includes a basin body 102 having four generally upright side walls 104A-D, and a basin bottom 106. The basin body 102, which for illustration includes a single bowl but may alternatively include more than a single bowl separated by divider walls (e.g., two, three, or more basins), in the known configuration, includes an inner, concave area having a drain 108. The drain 108 is shown positioned in a center of the basin bottom 106, however it should be understood that the position of the drain 108 may be offset from center, and/or may be in any suitable location of the basin bottom 106. The basin body also includes a top flange 110, which may rest on or under a countertop, cabinet, or other structure which acts to support the sink 100 in an undermount configuration, overmount configuration, or any other suitable configuration.

As shown in the Figures, the sink 100 has a generally rectangular cross section, however it should be understood that any other suitable shape may be used as well. Furthermore, the sink 100 may include one or more other features not shown, such as an apron front.

The sink 100 illustrated in FIGS. 1-6 includes one or more cutouts, ledges, grooves, or other structural features which act to support and secure one or more accessories for use along with the sink 100. In some examples, the sink may include pairs of ledges that act to support various accessories. It should be appreciated that the number of ledges may be fewer or greater than are shown in the Figures. In the embodiment illustrated in FIGS. 1-6, the sink 100 includes a top ridge 120 (comprising a rear top ridge 122 and a front top ridge 130), a bottom left ridge 150 (which wraps around the sink by extending from the rear wall 104A to the front wall 104B along the side wall 104C), and a bottom right ridge 170 (which wraps around the sink by extending from the rear wall 104A to the front wall 104B along the side wall 104D).

The sink 100 includes a top ridge 120, comprising a rear top ridge 122 and a front top ridge 130, which are configured to enable a cutting board, drying rack, or other accessory to rest on and be supported by the top ridge 120.

The rear top ridge 122 extends generally perpendicular to the rear wall 104A, and extends from the first side wall 104C to the second side wall 104D. It should be appreciated, however, that in some examples the rear top ridge 122 may extend only partially along the rear wall 104A, (e.g., may only extend from the first side wall 104C to a central point of the rear wall 104A, or may extend some other fractional amount along the rear wall 104A).

The rear top ridge 122 is shown extending parallel to the top flange 110, which enables any accessory supported by the rear top ridge to be level with the top flange 110 of the sink 100.

The rear top ridge 122 is positioned down from the top flange by a particular distance (e.g., one inch), and extends inward toward a center of the sink 100 by a particular distance (e.g., a half inch). This enables an accessory to be inserted into the sink such that it rests on the rear top ridge 122, and does not fall down to the bottom of the sink. The positioning and shape of the rear top ridge 122 also enables any given accessory to be supported on a bottom side by the rear top ridge 122, and to be held in place front to back by an upper portion 105 of the rear wall 104A. The accessory may also be held in place laterally or horizontally by the side wall 104C or 104D, depending on which side of the sink the accessory is placed.

In the sink shown in the Figures, the rear top ridge 122 includes curved first and second edges 124 and 126, which are tapered into the first side wall 104C and second side wall 104D respectively.

The rear top ridge 122 also includes a curved edge along its full length, to enable water, food, or other objects to be easily swept into the basin of the sink 100.

The front top ridge 130 mirrors the rear top ridge 122, and may be similar or identical. However, when an accessory is inserted into the sink 100, the rear top ridge 122 may support a rear edge or rear portion of the accessory, while the front top ridge 130 supports a front edge or front portion of the accessory.

The bottom left ridge 150 and the bottom right ridge 170 may be similar or identical to each other, and/or may be mirror images of each other. For the sake of brevity, only the bottom left ridge 150 is discussed in detail herein.

The bottom left ridge 150 includes a rear support 152, a side support 154, and a front support 156. The rear support 154 is defined by the rear wall 104A, the side support 154 is defined by the first side wall 104C, and the front support 156 is defined by the front wall 104B. Each of the rear support 152, side support 154, and front support 156 are aligned with each other to form a continuous ridge in the walls of the sink 100. It should be appreciated, however, that in some examples the rear support 152, side support 154, and/or front support 156 may be spaced apart from each other, such that a non-continuous ridge is formed.

In the illustrated example, the rear, side, and front supports of the bottom left ridge 150 are positioned on the respective side walls approximately one quarter of the distance from the bottom of the basin to the top of the basin. Additionally, the rear support 152 and the front support 156 extend along the respective rear wall 104A and front wall 104C from the side wall 104B inward toward the center of the sink, approximately one sixth of the distance between the first side wall 104C and the second side wall 104D.

The rear support 152 is configured to support a rear edge or rear portion of an accessory, the front support 156 is configured to support a front edge or front portion of the accessory, and the side support 154 is configured to support a side edge or side portion of the accessory.

In the illustrated example, each of the rear, side, and front supports 152, 154, and 156 include curved edges, to enable water, food, or other objects to be swept into the basin of the sink 100.

Further, in the illustrated example, the ends of the rear support 152 and the front support 156 curve upward toward the top flange 110 of the sink 100. As shown in the Figures, the top portion of the walls of the sink 100 that are above the bottom left ridge 150 are set back enable an accessory to be inserted onto the bottom left ridge 150 from the top opening of the sink 100. The bottom portion of the walls that are below the bottom left ridge extend inward toward a center of the sink, as compared to the top portion of the walls. This enables an accessory having dimensions larger than the cross sectional area of the bottom left ridge 150, but smaller than the cross sectional area of the top portion of the walls of the sink 100 to be inserted from the top of the sink, and rest on the bottom left ridge 150.

Figure 6:
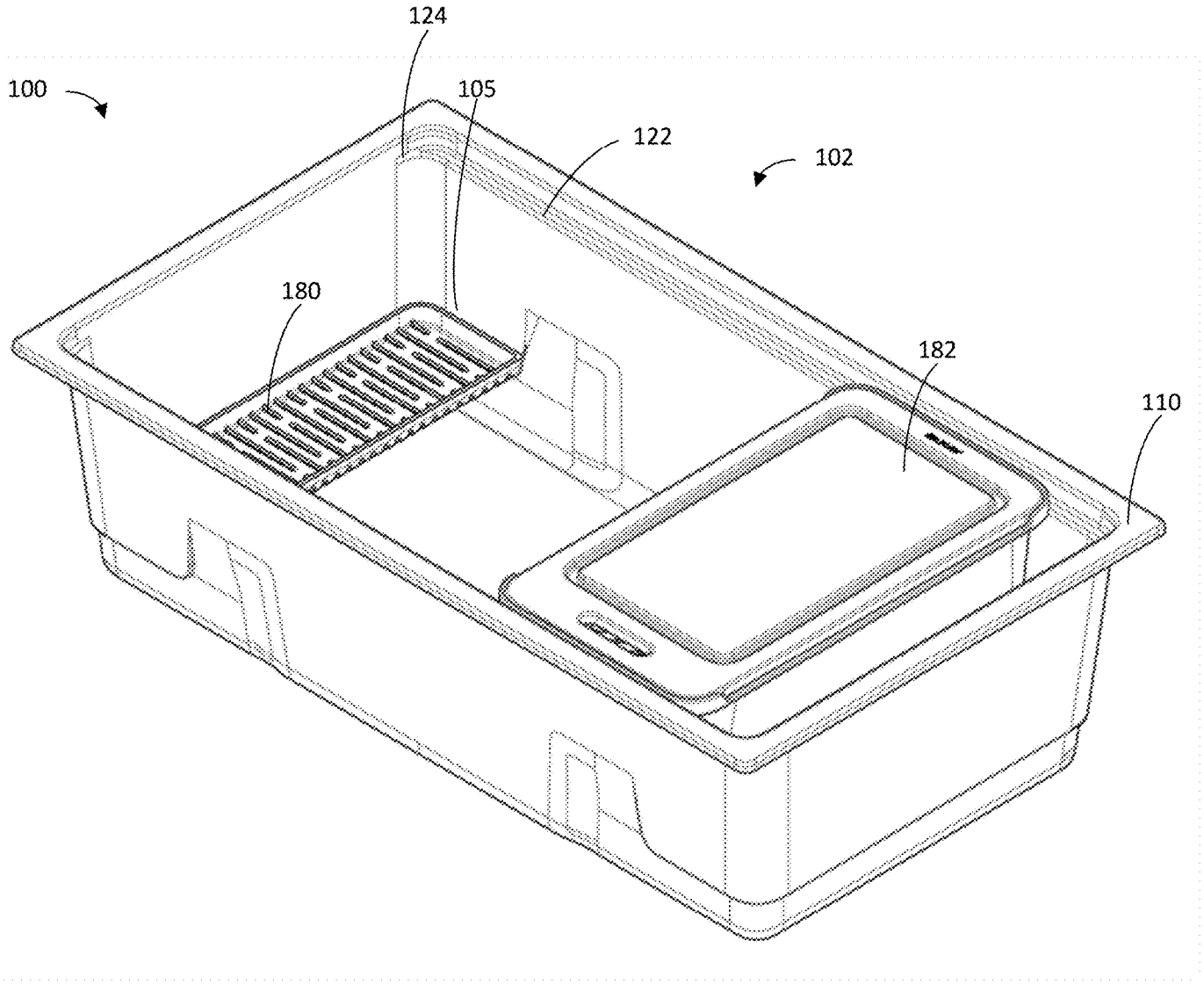
FIG. 6 illustrates a front perspective view of the sink of FIG. 1 along with various accessories inserted into the sink.

FIG. 6 illustrates the sink 100 with a first accessory 180 supported and located by the bottom left ridge 150, and a second accessory 182 supported and located by the top ridge 120. In the illustrated example, the first accessory 180 is a cutting board, and the second accessory 182 is a colander. In other examples, the first accessory 180 and/or the second accessory 182 may be a different accessory, such as a drying rack. Further, in some examples, multiple accessories, such as the first accessory 180 and another complimentary accessory, may be supported and located by the top ridge 120 simultaneously in a side-by-side manner.

Figure 7:
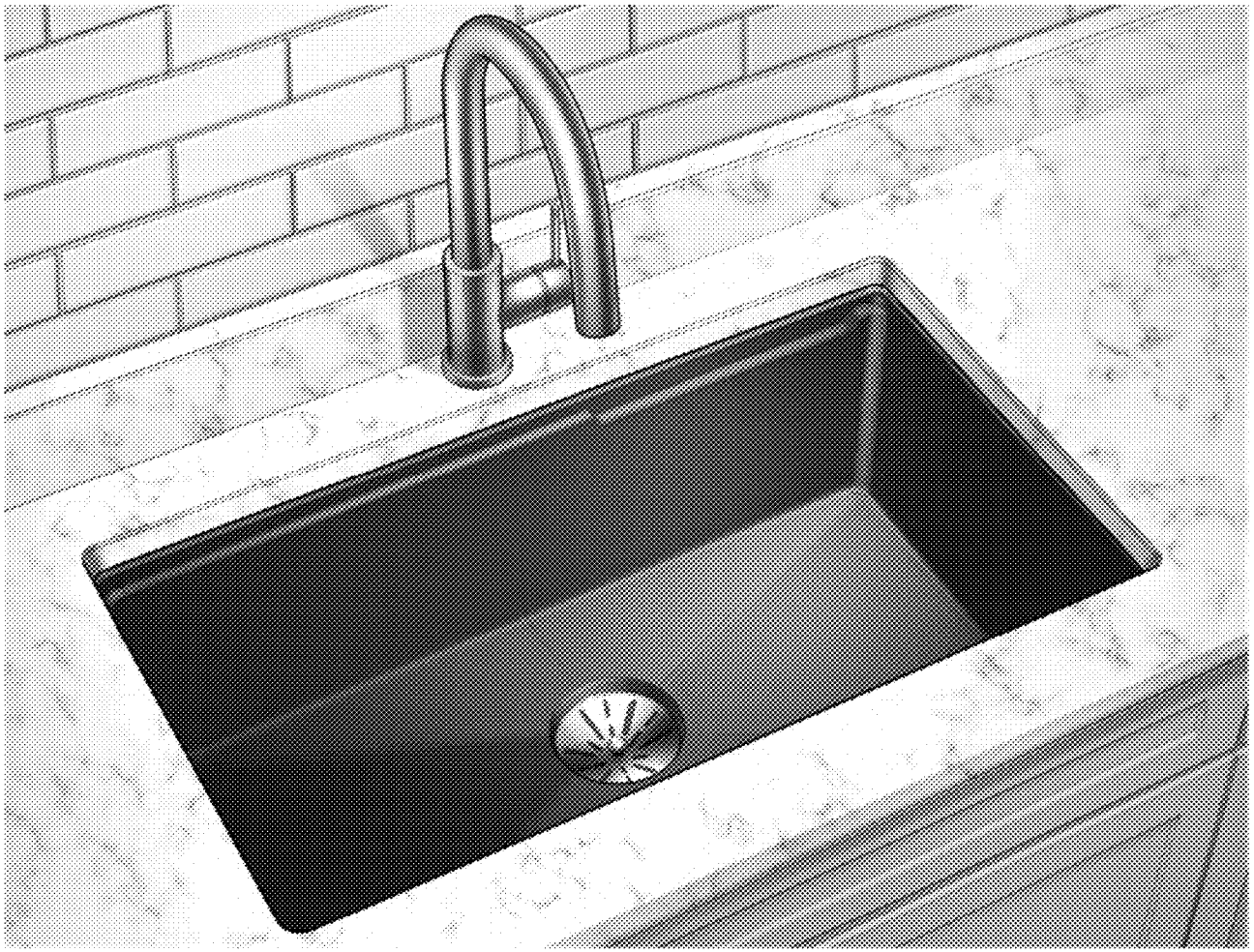
FIG. 7 illustrates a front perspective view of an example sink according to a second embodiment.
Figure 8:
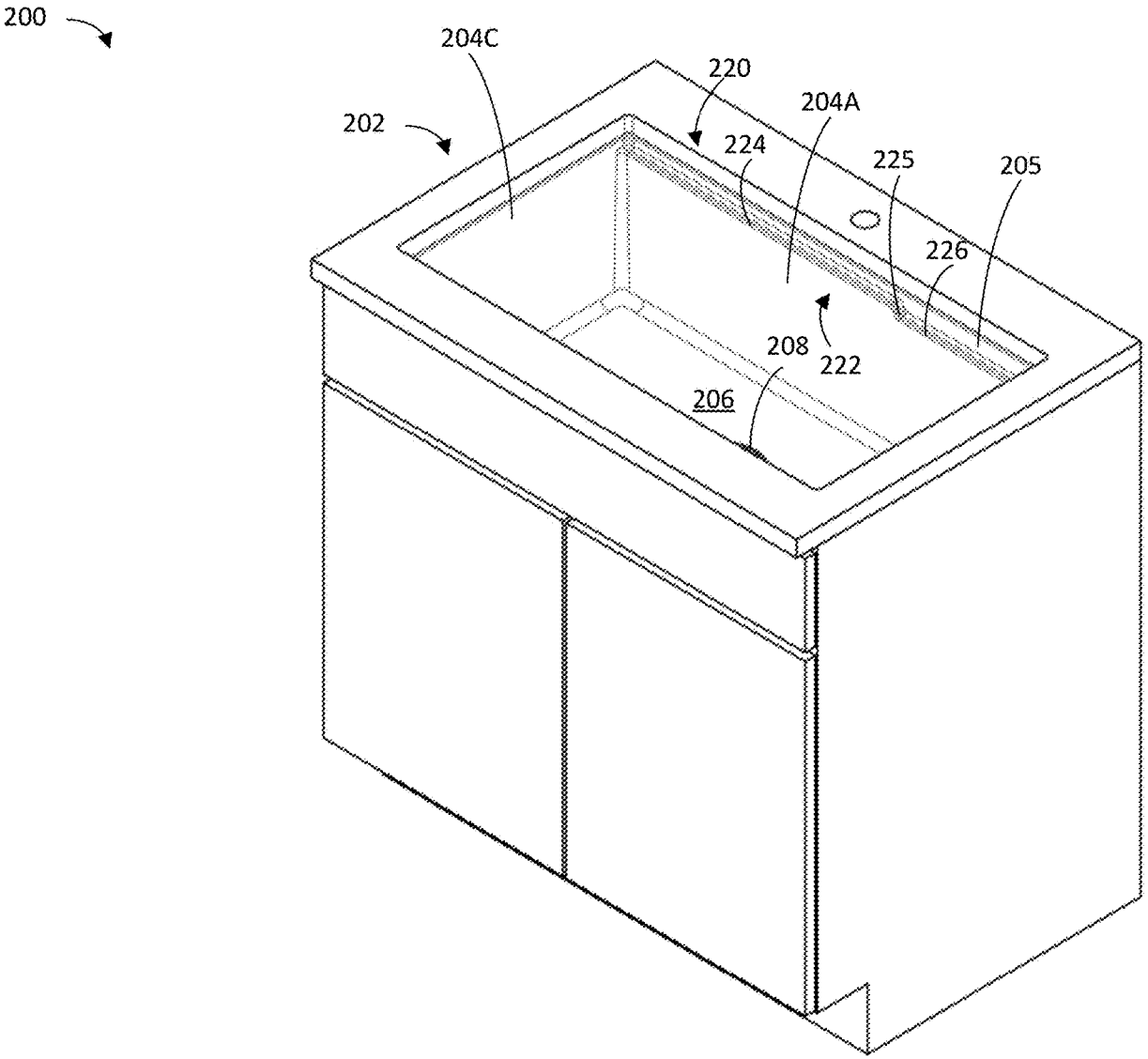
FIG. 8 illustrates another front perspective view of the sink of FIG. 7.
Figure 9:
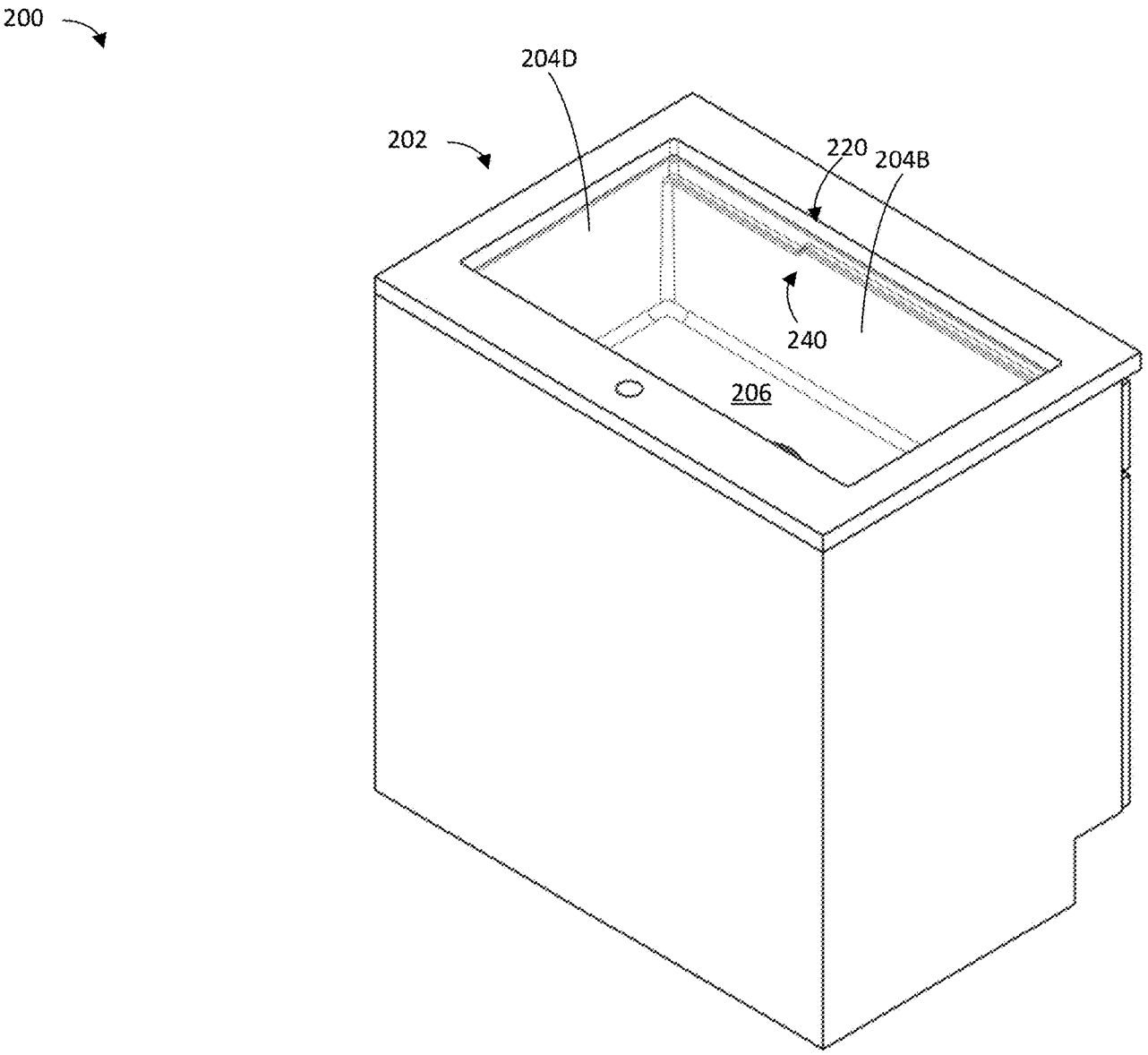
FIG. 9 illustrates a rear perspective view of the sink of FIG. 7.
Figure 10:
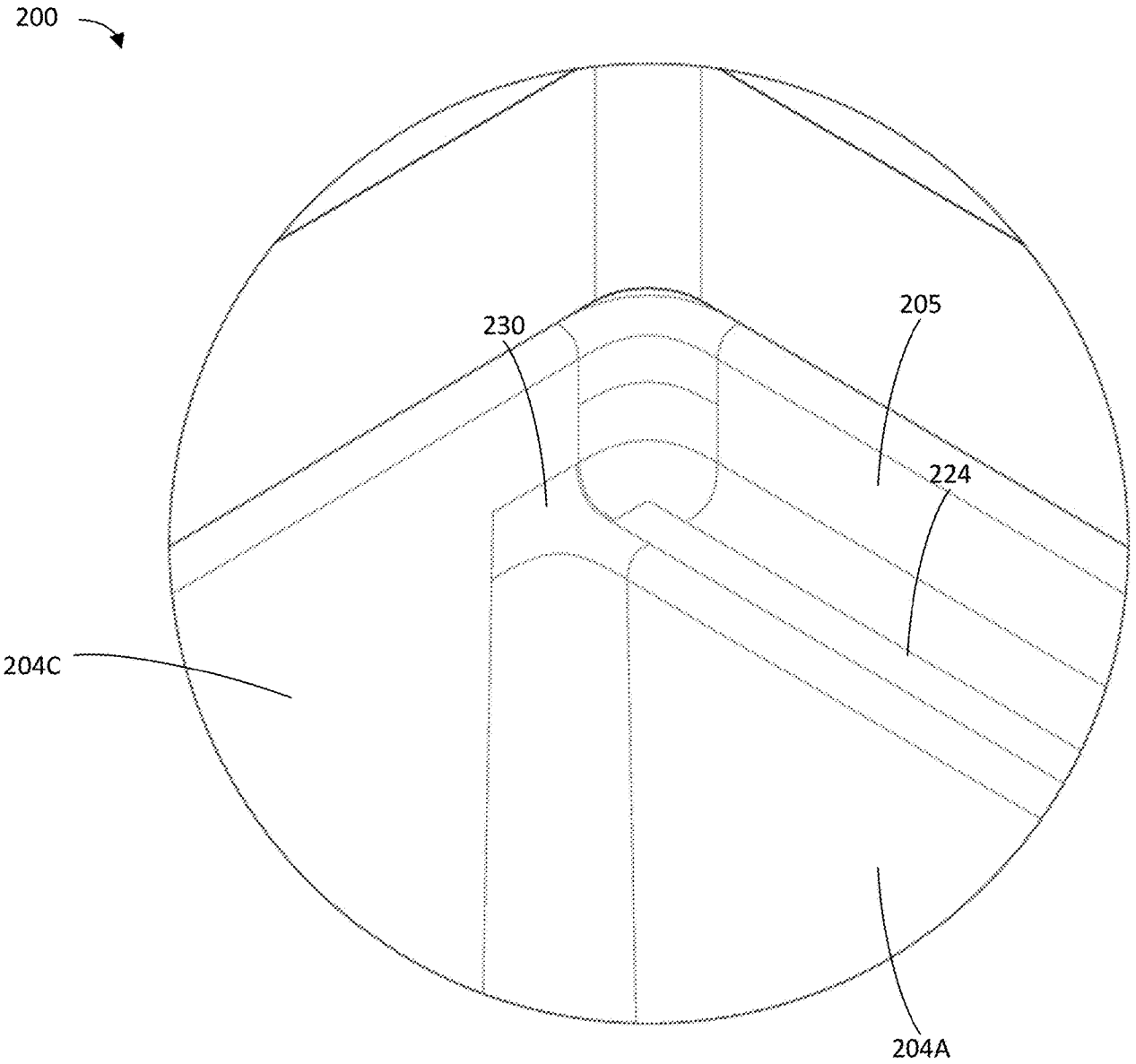
FIG. 10 illustrates a zoomed in view of an interior upper left corner of the sink of FIG. 7, showing the ridge.
Figure 11:
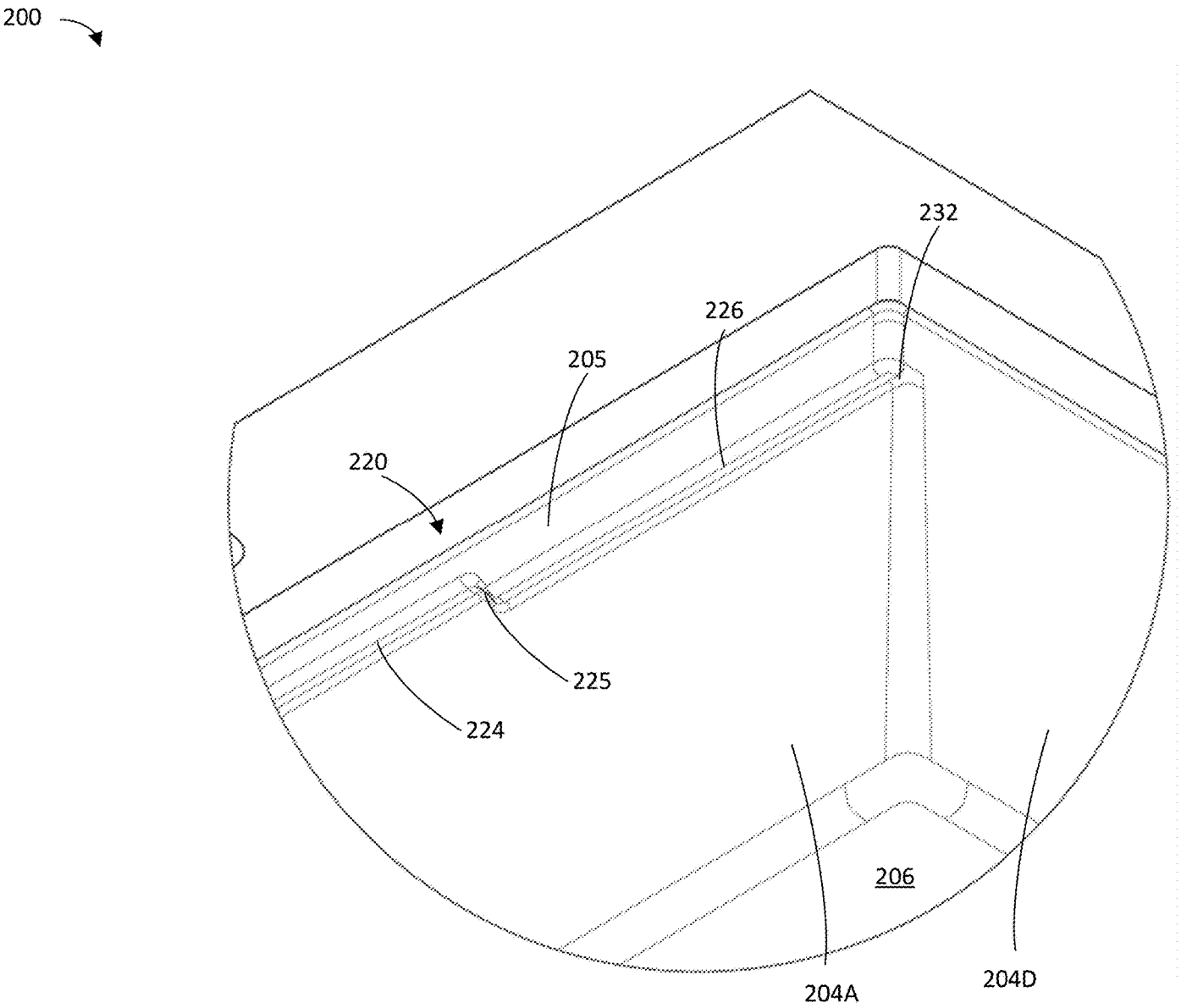
FIG. 11 illustrates a zoomed in view of an interior upper right corner of the sink of FIG. 7, showing the ridge.

FIGS. 7-12 illustrate a second example or second configuration of supporting structures for accessories in a sink. A sink 200 is shown in FIG. 7. The sink 200 may be a molded, quartz sink, and/or may be made from some other material. The sink 200 includes a basin body 202 having four generally upright side walls 204A-D, and a basin bottom 206. The basin body 202, which for illustration includes a single bowl but may alternatively include more than a single bowl separated by divider walls (e.g., two, three, or more basins), in the known configuration, includes an inner, concave area having a drain 208. The drain 208 is shown positioned in a center of the basin bottom 206, however it should be understood that the position of the drain 208 may be offset from center, and/or may be in any suitable location of the basin bottom 206. The basin body also includes a top flange (not labeled), which may rest on or under a countertop, cabinet, or other structure which acts to support the sink 200 in an undermount configuration, overmount configuration, or any other suitable configuration.

The sink 200 includes a top ridge 220, comprising a rear top ridge 222 and a front top ridge 240, which are configured to enable a cutting board, drying rack, or other accessory to rest on and be supported by the top ridge 220. The rear top ridge 222 and the front top ridge 240 may be mirror images of each other. For brevity, only the rear top ridge 222 will be described in detail.

The rear top ridge 222 extends generally perpendicular to the rear wall 204A, and extends from the first side wall 204C to the second side wall 204D. It should be appreciated, however, that in some examples the rear top ridge 222 may extend only partially along the rear wall 204A, (e.g., may only extend from the first side wall 204C to a central point of the rear wall 204A, may be positioned in a central portion of the rear wall 204A, or may extend some fractional amount along the rear wall 204A).

The rear top ridge 222 is shown extending parallel to the top flange (not labeled), which enables any accessory supported by the rear top ridge 222 to be level with the top flange (not labeled) of the sink 200.

The rear top ridge 222 may include an upper portion 224 and a lower portion 226. The upper portion 224 and the lower portion 226 may be positioned side-by-side, and connected to form a continuous ridge. The upper portion 224 may be connected to the lower portion 226 by an angled portion 225, such that when an accessory is positioned to be supported by the rear top ridge, the angled portion 225 of the rear top ridge 222 directs the accessory toward the lower portion 226. This enables the accessory to be supported by the lower portion 226, and also ensures that the accessory is secured in position and will not move laterally from side to side.

The top portion of the rear top ridge 222 is positioned down from the top flange 110 by a particular distance (e.g., one inch), and the bottom portion is positioned town from the top flange by a second, greater distance (e.g., two inches). Both the top portion and the bottom portion of the rear top ridge 222 extend inward toward a center of the sink 200 by a particular distance (e.g., a half inch). This enables an accessory to be inserted into the sink such that it rests on the rear top ridge 222, and does not fall down to the bottom of the sink. The positioning and shape of the rear top ridge 222 also enables any given accessory to be supported on a bottom side by the rear top ridge 222, and to be held in place front to back by an upper portion 205 of the rear wall 204A. The accessory may also be held in place laterally or horizontally by the side wall 204C or 204D, depending on which side of the sink the accessory is placed, or by the angled portions 225 of the rear top ridge 222.

In the sink 200 shown in FIGS. 7-12, the rear top ridge 222 includes curved first and second edges 230 and 232, which are tapered into the first side wall 204C and second side wall 204D respectively.

The rear top ridge 222 also includes a curved edge along its full length, to enable water, food, or other objects to be easily swept into the basin of the sink 200.

The front top ridge 240 mirrors the rear top ridge 222, and may be similar or identical. However, when an accessory is inserted into the sink 200, the rear top ridge 222 may support a rear edge or rear portion of the accessory, while the front top ridge 240 supports a front edge or front portion of the accessory.

As shown in FIGS. 7-12, the lower portion 226 of the rear top ridge 222 is positioned on a right side of the sink when viewed from the front. It should be understood that the lower portion 226 may alternatively be positioned on the left side, in the middle, or in any other suitable position along the length of the sink 200.

Furthermore, the illustrated example includes only one lower portion 226. However, other examples may include two or more lower portions, which may be separated from each other by one or more upper portions of the ridge. Additionally, the sizing and spacing of the ridges (both upper and lower portions) may also be different than is illustrated in the Figures.

Figure 12:
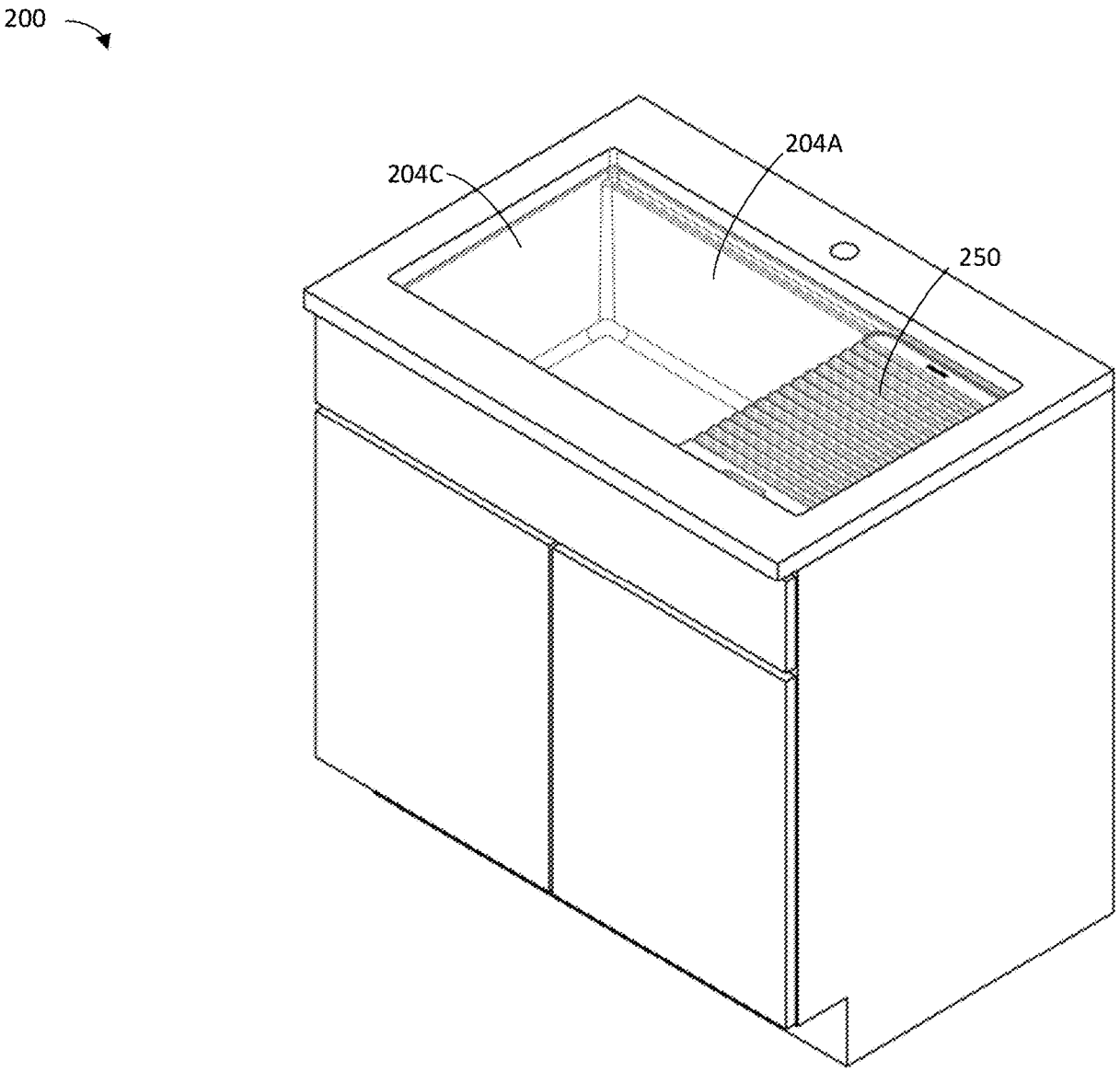
FIG. 12 illustrates a front perspective view of the sink of FIG. 7 along with an accessory inserted into the sink.
Figure 13:
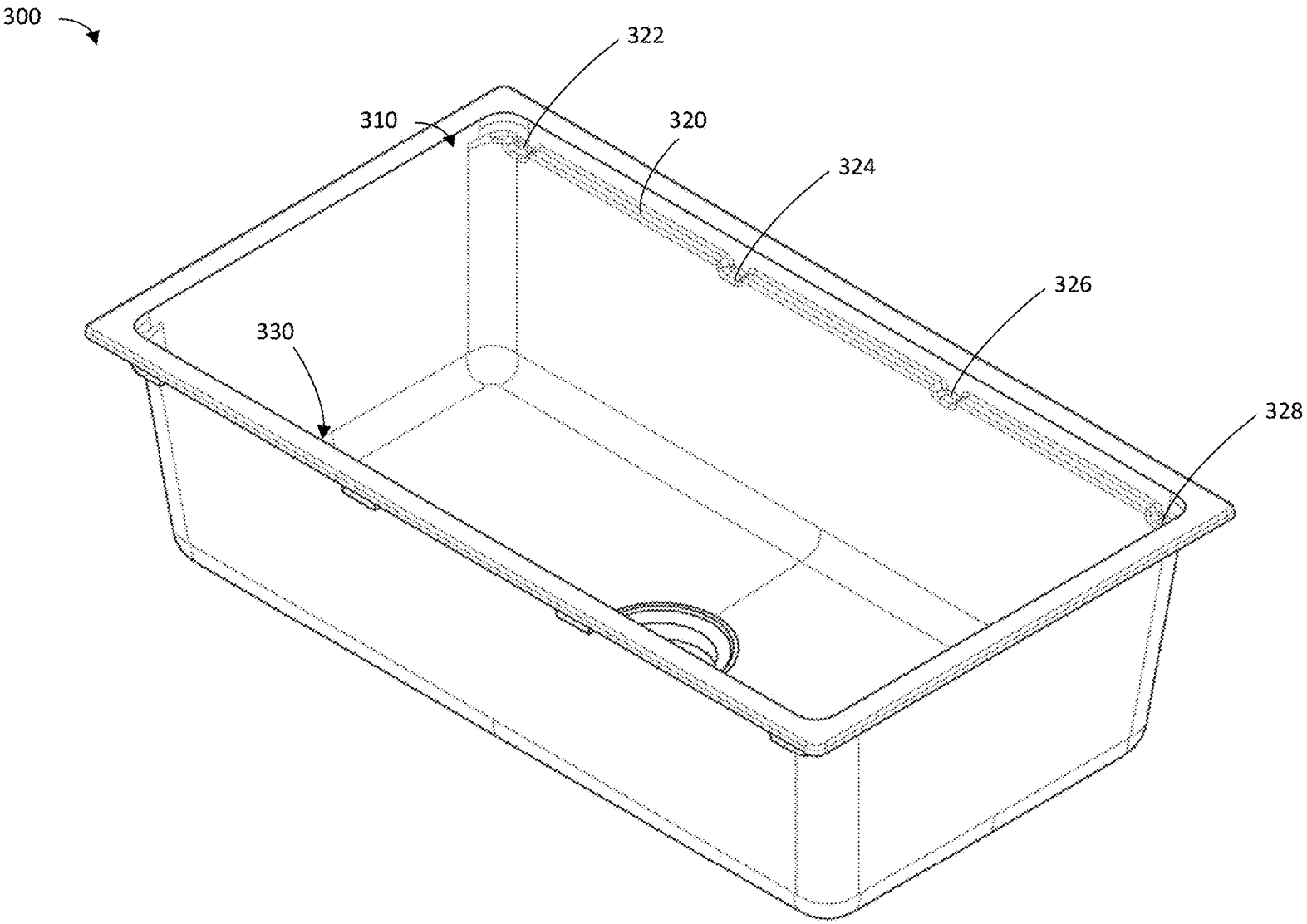
FIG. 13 illustrates a front perspective view of a sink including an alternative upper ridge configuration according to various embodiments.

FIG. 12 illustrates an accessory 250 positioned and located on the lower portion of the ridge, locked in place. In the illustrated example, the accessory 250 is a drying rack. In other examples, the accessory 250 may be a different accessory, such as a cutting board or a colander. Additionally or alternatively, the accessory 250 and/or another accessory is supported and located by the upper portion of the ridge. Further, in some examples, multiple accessories, such as the accessory 250 and another complimentary accessory, may be supported simultaneously by the lower and/or upper portions of the ridge (e.g., on opposing sides of the basin body 202). For example, the upper ridge is configured to support one or more accessories while the lower portion of the ridge supports one or more other accessories.

FIGS. 13-16 illustrate an additional or alternative configuration of ridges of a sink. The sink 300 shown in FIGS. 13-16 includes an upper ridge 310, comprising a rear ridge 320 and a front ridge 330. The rear ridge comprises four detents 322, 324, 326, and 328. The front ridge 330 mirrors the rear ridge 320.

The four detents 322, 324, 326, and 328 are shown spaced evenly apart along the length of the rear ridge 320. However, it should be appreciated that there may be more or fewer detents, and/or the positioning of the detents may be different. The detents may be concentrated on either the left side or the right side, may be unevenly spaced, or may have some other configuration.

Figure 14:
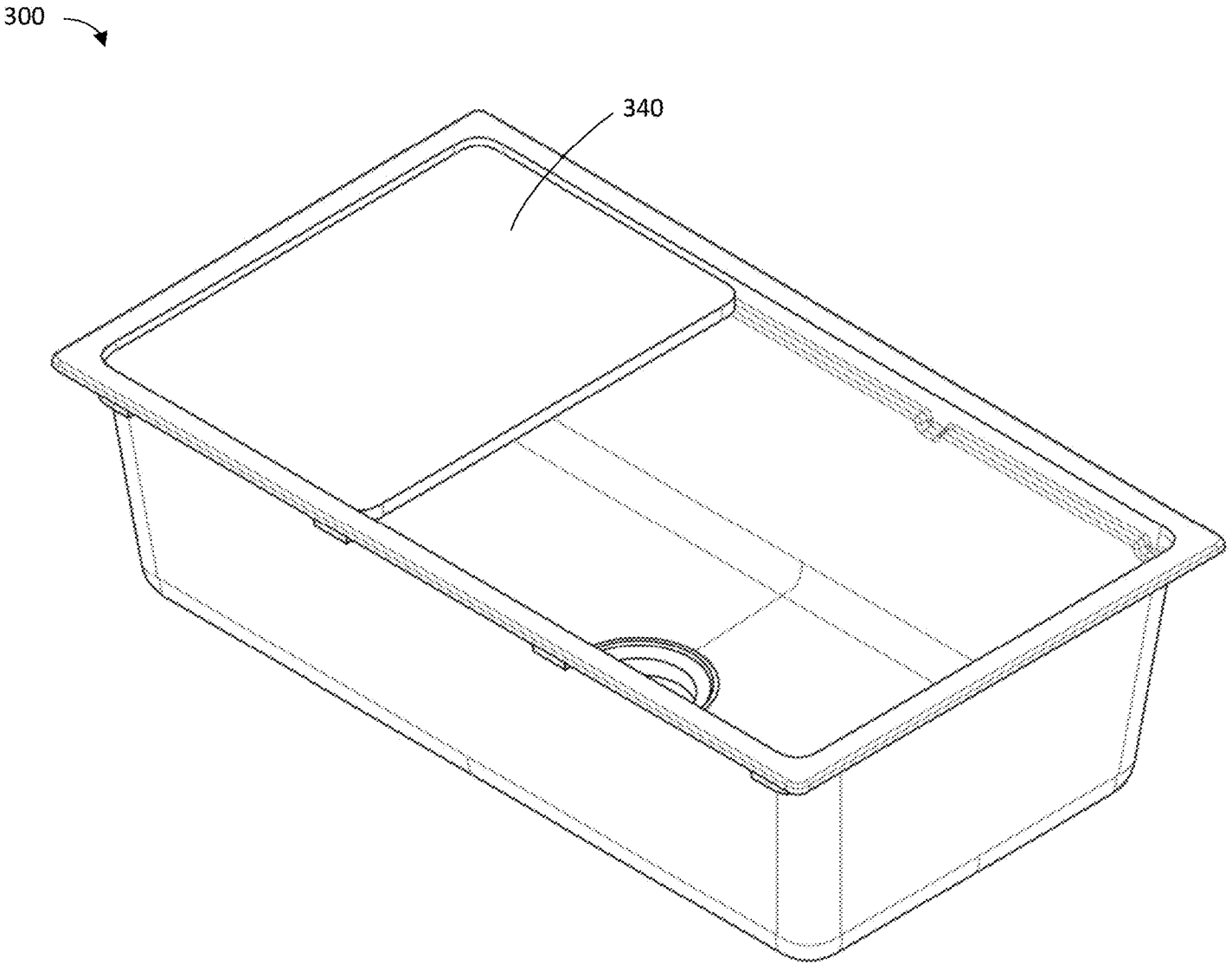
FIG. 14 illustrates a front perspective view of the sink of FIG. 13 including an accessory.
Figure 15:
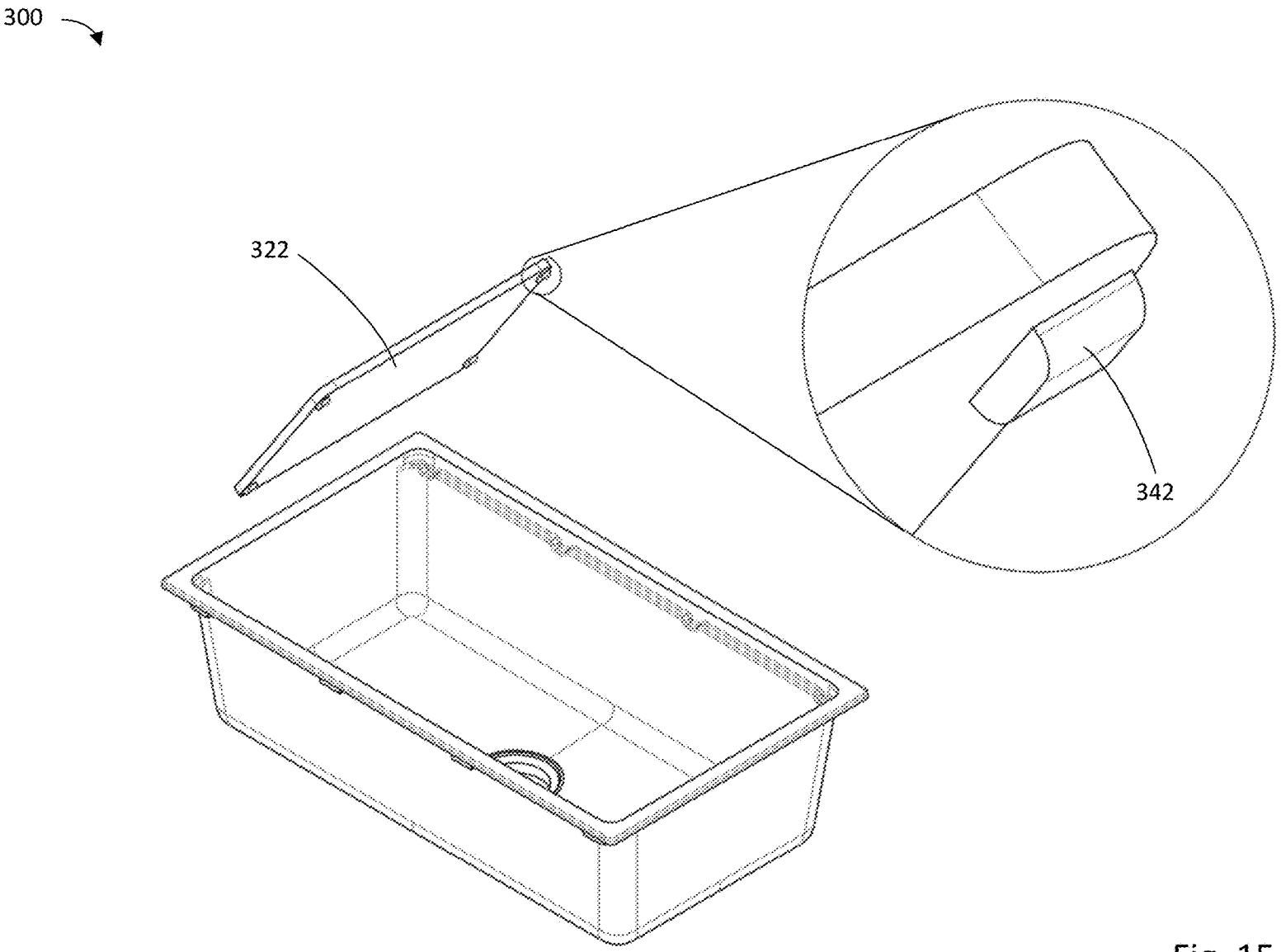
FIG. 15 illustrates a front perspective view and a zoomed in view of an accessory and the sink of FIG. 13.
Figure 16:
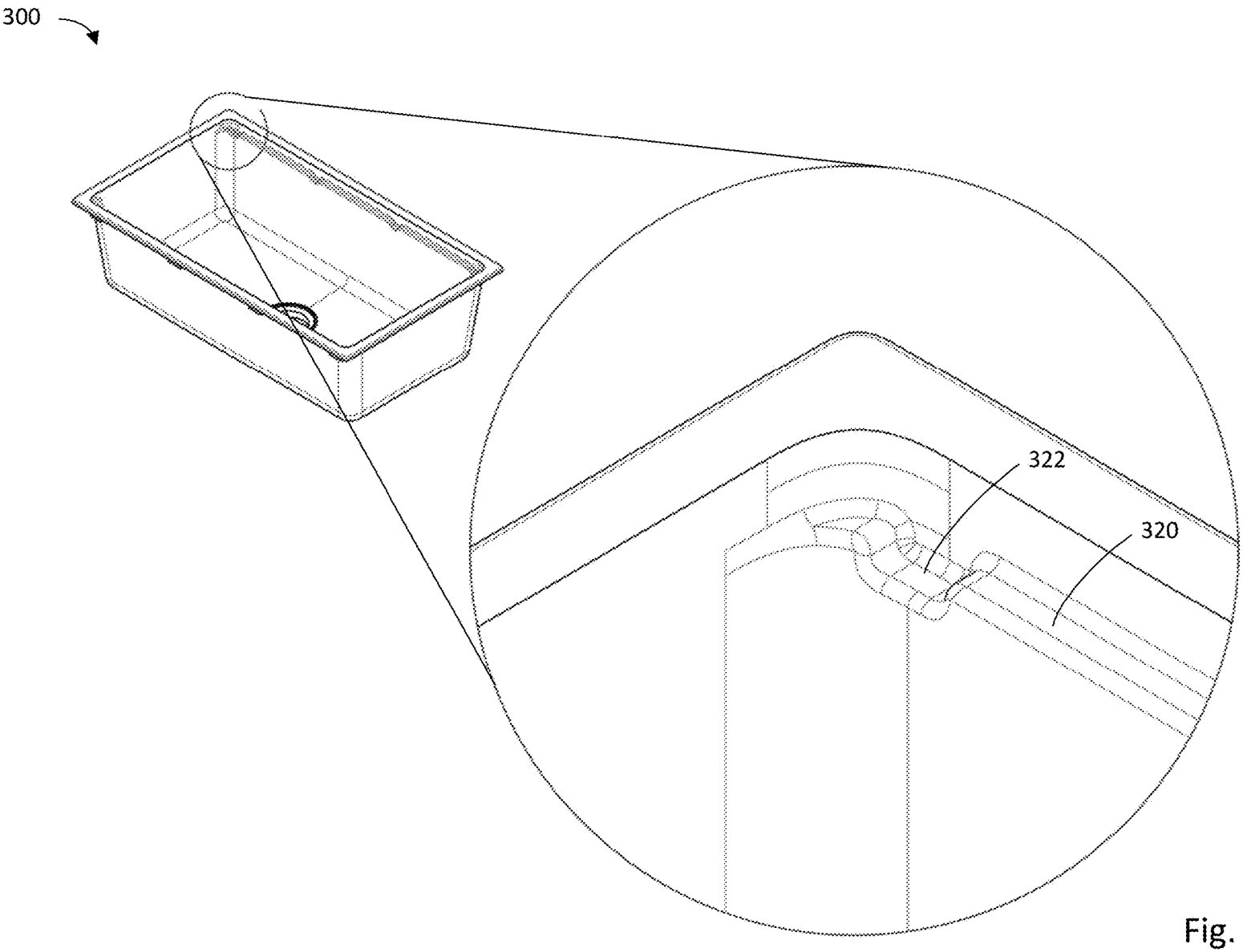
FIG. 16 illustrates a zoomed in view of the ridge of the sink of FIG. 13.

The detents 322, 324, 326, and 328 are configured to accept or engage with tabs or other components that extend from an accessory, for example accessory 340 shown in FIGS. 14 and 15. The accessory tabs 342 of the accessory 340 can be spaced apart to match the detent spacing on the upper ridge 310, such that the accessory 340 is locked in place. In the illustrated example, the accessory 340 is a cutting board. In other examples, the accessory 340 may be a different accessory, such as a drying rack or a colander. Further, in some examples, multiple accessories may be supported and located simultaneously by the upper ridge 340 (e.g., on opposing ends of the sink 300). For example, one complimentary accessory may be securely received by the detents 322, 324, and another complimentary accessory may be securely received by the detents 326, 328.

The embodiments and examples disclosed herein may include sinks that are made from quartz, quartz composite, and./or any other suitable material .IT should be understood that the locking mechanisms for accessories (e.g., the various ridges disclosed herein) may be used with sinks made from various materials.

Further, it should be appreciated that various combinations of ridges, ridge positioning, detents, and detent positioning may be used. For example, one or both of the sinks 100 and 200 described with reference to FIGS. 1-6 and 7-12 respectively may alternatively or additionally have ridges that include one or more detents such as those illustrated and described with reference to FIGS. 13-16.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure.

What is claimed is:

1. A sink comprising:

a basin including a rear wall, a front wall, a first side wall, a second side wall, and a bottom; and a top flange connected to the basin, wherein the basin defines a top ridge below the top flange, wherein the top ridge includes a rear top ridge extending inward from the rear wall and also extending inward from at least a portion of the first side wall and at least a portion of the second side wall, the rear top ridge extending along the rear wall from the first side wall to the second side wall, and wherein the basin defines at least one bottom ridge extending inward from the rear wall, the front wall, and one of the first side wall and second side wall, the bottom ridge including an upward taper along the rear wall and an upward taper along the front wall.

2. The sink of claim 1, wherein the top ridge is configured to support and locate a first accessory.

3. The sink of claim 2, wherein the bottom ridge is configured to support and locate a second accessory.

4. The sink of claim 1, the sink further comprising a front top ridge that extends inward from the front wall opposite the rear top ridge.

5. The sink of claim 1, wherein the at least one or more-bottom ridge includes a first bottom ridge that extends inward from the rear wall, the front wall, and the first side wall.

6. The sink of claim 5, wherein the at least one bottom ridge ridges further includes a second bottom ridge that extends inward from the rear wall, the front wall, and the second side wall.

7. The sink of claim 6, wherein the first bottom ridge is configured to support and locate a first accessory and the second bottom ridge is configured to support and locate a second accessory.

8. The sink of claim 1, wherein each bottom ridge includes a rear support defined by the rear wall, a side support defined by the first side wall or the second side wall, and a front support defined by the front wall.

9. The sink of claim 1, wherein each of the top ridge and the at least one bottom ridge includes a curved edge to facilitate material in being swept into the basin.

10. A sink comprising:

a basin including a rear wall, a front wall, a first side wall, a second side wall, and a bottom; and a top flange connected to the basin, a top ridge defined by the basin below the top flange, the top ridge comprising:

a first upper portion extending inward from the rear wall and along the rear wall from the first side wall at a first depth relative to the top flange;

a first lower portion extending inward from the rear wall and along the rear wall from the second side wall at a second depth relative to the top flange; and a first angled portion connecting the first upper portion and the first lower portion.

11. The sink of claim 10, wherein the first upper portion is configured to support and locate an accessory.

12. The sink of claim 10, wherein the first lower portion is configured to support and locate an accessory.

13. The sink of claim 10, wherein the top ridge further comprises a second upper portion extending inward from the front wall and along the front wall from the first side wall such that the second upper portion is opposite the first upper portion.

14. The sink of claim 13, wherein the top ridge further comprises a second lower portion extending inward from the front wall and along the front wall from the second side wall such that the second lower portion is opposite the first lower portion.

15. The sink of claim 14, wherein the top ridge further comprises a second angled portion connecting the second upper portion and the second lower portion.

16. The sink of claim 10, wherein the top ridge extends between the first side wall and the second side wall.

17. A sink comprising:

a top flange; and a basin connected to the top flange and including a rear wall, a front wall, a first side wall, a second side wall, a bottom, and a rear ridge, wherein the rear ridge extends inward from the rear wall, at least a portion of the first side wall, and at least a portion of the second side wall below the top flange, the rear ridge extending along the rear wall from the first side wall to the second side wall, wherein the rear ridge defines a first plurality of detents that are spaced apart from each other along a length of the rear ridge, and wherein each of the first plurality of detents are configured to engage a tab of an accessory to lock the accessory in place, the first plurality of detents defining a plurality of predetermined positions along a length of the rear ridge, each of the first plurality of detents being configured to selectively receive at least one accessory in an associated one of the plurality of predetermined positions.

18. The sink of claim 17, wherein the first plurality of detents are spaced evenly apart along the length of the rear ridge.

19. The sink of claim 17, wherein the basin further includes a front ridge that extends inward from the front wall below the top flange, and wherein the front ridge defines a second plurality of detents opposite the first plurality of detents.

* * * * *